United States Patent [19]

van der Sluys

[11] Patent Number: 4,561,259

[45] Date of Patent: Dec. 31, 1985

[54] METHOD OF OPERATING A BIMODAL HEAT PUMP AND HEAT PUMP FOR USE OF THIS METHOD

[75] Inventor: Willem L. N. van der Sluys, Eindhoven, Netherlands

[73] Assignee: U.S. Philips Corporation, New York, N.Y.

[21] Appl. No.: 696,627

[22] Filed: Jan. 31, 1985

Related U.S. Application Data

[63] Continuation of Ser. No. 531,113, Sep. 12, 1983, abandoned.

[30] Foreign Application Priority Data

Jul. 8, 1983 [NL] Netherlands ..... 8302437

[51] Int. Cl.[4] ..... F25B 15/00

[52] U.S. Cl. ..... 62/101; 62/238.3; 62/324.2; 62/476

[58] Field of Search ..... 62/324.2, 476, 101, 62/238.3

[56] References Cited

U.S. PATENT DOCUMENTS

| | | | |
|---|---|---|---|
| 4,312,476 | 1/1982 | Pohlmann | 62/238.3 X |
| 4,394,959 | 7/1983 | de Vries | 62/324.2 X |
| 4,448,596 | 5/1984 | van der Sluys et al. | 62/324.2 |

*Primary Examiner*—Lloyd L. King

*Attorney, Agent, or Firm*—Rolf E. Schneider

[57] ABSTRACT

A method of operating a bimodal heat pump is provided, such heat pump operating in a first mode as an absorption heat pump and in a second mode as a device for indirectly heating a heat-transport medium. This procedure comprises in the first mode heating by heat exchange a generator containing a solution of a working medium in a solvent to separate a part of the dissolved working medium in the gaseous state from the solvent, passing the separated gaseous working medium to a condenser for liquefaction by the giving up of thermal energy to the heat-transport medium, thereafter expanding and evaporating the liquefied working medium in an evaporator by the taking up of thermal energy from the environment, passing the evaporated working medium to an absorber for solution in the solvent while giving up thermal energy to the heat-transport medium, and passing another part of the working medium-solvent solution from the generator to the absorber while pumping working medium-solvent solution from the absorber to the generator. The procedure also comprises in the second mode indirectly heating by heat exchange all the heat-transport medium in a heat boiler separate from the generator. The procedure further comprises, in switching over from the first mode to the second mode, discontinuing the heating of the generator, discontinuing the pumping of the working medium-solvent solution between the absorber and the generator, and diverting all the heat-transport medium to and through the heat boiler for indirect heating by heat exchange therein. In addition, the procedure comprises, in switching back from the second mode to the first mode, restarting the heating of the generator and the pumping of the working medium-solvent solution, and discontinuing passing the heat-transport medium through the heat boiler.

5 Claims, 1 Drawing Figure

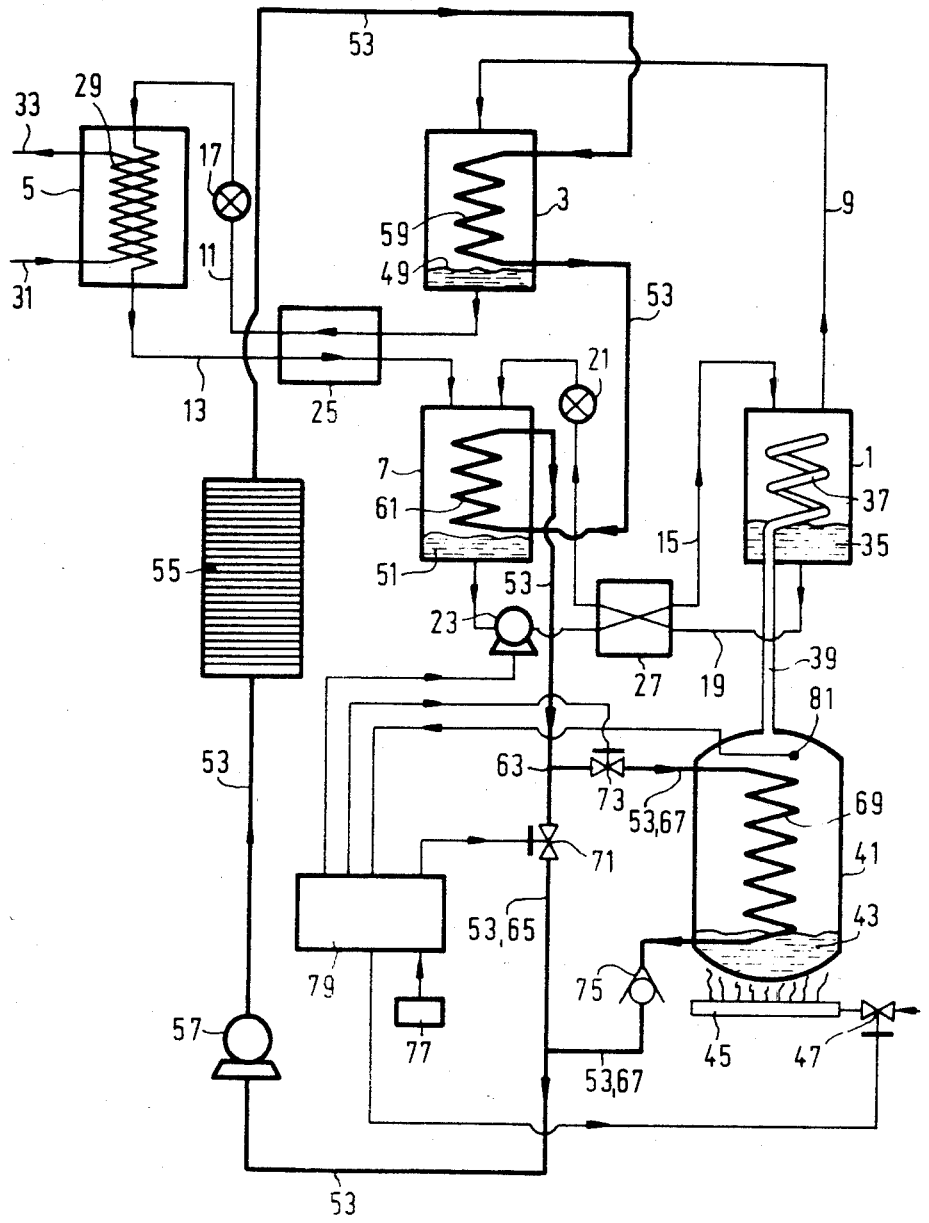
53
33
29
17
5
3
9
59
11
49
31
53
21
13
25
7
1
61
37
15
35
55
51
53
23
27
19
39
81
53
63
73
53,67
69
71
41
53,65
43
79
75
57
77
45
47
53,67
53

METHOD OF OPERATING A BIMODAL HEAT PUMP AND HEAT PUMP FOR USE OF THIS METHOD

This is a continuation of application Ser. No. 531,113 filed Sept. 12, 1983, now abandoned.

This invention relates to a method of operating a bimodal heat pump which operates as an absorption heat pump in a first mode, in which a working medium passes through a first cycle comprising a generator, a condenser, an evaporator and an absorber, while a solution of the working medium and a solvent passes through a second cycle between the generator and the absorber and heat is transferred in the condenser and the absorber to a heat transport medium in a system of pipes, whereby in this heat pump in a second mode the generator, the condenser, the evaporator and the absorber are made thermally inoperative and the heat transport medium is heated by a heat source arranged separately from the absorption heat pump.

The invention also relates to a heat pump for use in such method.

In a known method of the kind described above (see Published German Application OS No. 2943275), a solution of a working medium in a solvent is heated in the generator by means of a burner arranged directly below the generator in the first mode of the heat pump, in which first mode this pump operates as an absorption heat pump. The direct heating of the generator leads to the formation of a stationary film of the solution on the bottom of the generator. In this film the heat conduction is comparatively poor, as a result of which high film temperatures can occur, which may cause decomposition of the working medium. For example, decomposition products, such as, nitrogen and hydrogen, are formed if ammonia is used as the working medium. The operation of the condenser, but especially that of the absorber, is unfavourably influenced by decomposition products such as nitrogen and hydrogen. In the case of a comparatively low ambient temperature, in an alternative of the known method use is made in the second mode of indirect heating of the generator instead of the preferably used heat exchange with the heat-transport medium in the generator. In this alternative, an auxiliary medium, such as oil, heated by a burner is utilized in a so-called intermediate cycle outside the generator. The heated oil is passed to a heat exchanger for heat transfer to the heat transport medium comprising water. A disadvantage of such method in the second mode of the heat pump resides not only in the necessity of the use of a second burner and an oil pump, but also in the comparatively small heat transfer coefficient during the heat transfer from the oil to the water.

The present invention has for its object to provide a method in which such disadvantages in the first mode and the second mode of the heat pump are avoided.

The method according to the invention is characterized in that in the first mode heat is transferred to the working medium by means of a first heat exchanger in the generator whilst utilizing the condensation heat of a gaseous auxiliary medium formed by evaporation of a liquid auxiliary medium in a heat boiler connected to the first heat exchanger, while in the second mode heat is transferred to the heat-transport medium by passing this medium through a second heat exchanger arranged in the heat boiler.

The invention further has for its object to provide a heat pump for use in such method.

A heat pump according to the invention is characterized in that the system of pipes for the heat-transport medium extending through the condenser and the absorber is branched off after the absorber and comprises a primary pipe having a first valve and a secondary pipe which extends parallel to the primary pipe and which is introduced into the heat boiler and includes the second heat exchanger, whereby, viewed in the transport direction of the heat-transport medium, a second valve is arranged before the second heat exchanger in the secondary pipe.

A particular embodiment of the heat pump is characterized in that, viewed in the transport direction of the heat-transport medium, a non-return valve is arranged after the second heat exchanger in a vertical part of the secondary pipe between the second heat exchanger and the primary pipe. The non-return valve prevents in the first mode of the heat pump heat-transport medium of a comparatively low temperature arriving in the second heat exchanger in the heat boiler. Since the second heat exchanger has a comparatively high temperature, undesired pressure surges could occur in the second heat exchanger in the absence of a non-return valve.

A further embodiment of the heat pump is characterized in that the heat boiler is a steam boiler which is heated by a controllable heat source. The use of a steam boiler yields a very good heat transfer coefficient both in the first mode and in the second mode because in both modes the heat transfer takes place by means of condensation of steam both in the first heat exchanger in the generator and in the second heat exchanger in the steam boiler.

The invention will now be described more fully with reference to the accompanying drawing, which shows diagrammatically a heat pump for the two modes of operation.

The preferred embodiment of a heat pump according to the invention has a first cycle in which a working medium, such as, for example, ethyl amine, is passed successively through a generator 1, a condenser 3, an evaporator 5 and an absorber 7. The first cycle comprises further a pipe 9 between the generator 1 and the condenser 3, a pipe 11 between the condenser 3 and the evaporator 5, a pipe 13 between the evaporator 5 and the absorber 7 and a pipe 15 between the absorber 7 and the generator 1. A thermostatic expansion valve 17 is arranged in the pipe 11 just before the evaporator 5. The heat pump has a second cycle in which a solution of the working medium, such as ethyl amine, and a solvent, such as glycol, is passed successively through the generator 1 and the absorber 7. The second cycle comprises further a pipe 19 between the generator 1 and the absorber 7 and the pipe 15 between the absorber 7 and the generator 1. An expansion valve 21 is arranged in the pipe 19 just before the absorber 7. The solution is pumped from the absorber 7 to the generator 1 by means of a pump 23 arranged in the pipe 15. The comparatively hot working medium in the pipe 11 is passed from the condenser 3 in counterflow with the comparatively cold working medium in the pipe 13 by means of a heat exchanger 25. The liquid working medium in the pipe 11 is thereby undercooled so that the evaporation in the evaporator 5 is intensified. The undercooling enthalpy extracted from the liquid working medium is transferred in the heat exchanger 25 to the gaseous working medium in the pipe 13, which results in an improvement of the efficiency of the heat pump. Exchange of heat takes place between the hot poor solution in the pipe 19 and the cold rich solution in the pipe 15 in a counterflow heat exchanger 27. Thus, the cold rich solution, already in the preheated state, flows into the generator 1, which results in an increase of the efficiency of the heat pump. The second cycle acts as a so-called thermal compressor. The evaporator 5 includes a heat exchanger 29 in which heat is transferred to the working medium to be evaporated. The heat required to this end is extracted from an external heat source, such as, for example, underground water, which is supplied through a pipe 31 and is drained through a pipe 33.

The generator 1, which contains a solution 35, of a working medium (ethyl amine) and a solvent (glycol) is provided with a heat exchanger 37 which consists of a coiled pipe which is closed at one end and is connected at the other end through a riser pipe 39 to a heat boiler 41 arranged below the generator 1. The heat boiler 41 contains a liquid auxiliary medium 43, such as, for example, water. The heat boiler 41 is heated by means of a multi-stage gas burner 45, which is controlled by an adjustable gas valve 47. For the sake of completeness, it is pointed out that the condenser 3 contains a quantity of liquid working medium (ethyl amine) 49 and the absorber 7 contains a quantity of liquid solution (ethyl amine+glycol) 51. The heat pump further has a ring pipe 53 (system of pipes) for a heat-transport medium, in the present case water in the liquid state. The ring pipe 53 includes a heat exchanger 55 intended for room heating. The water in the ring pipe 53 is circulated by a pump 57. Heat exchangers 59 and 61 form part of the ring pipe 53 and are arranged in the condenser 3 and the absorber 7, respectively. The ring pipe 53 has after the absorber 7 a branch 63 to a primary pipe 65 and a secondary pipe 67 extending parallel thereto. The secondary pipe 67 is provided with a heat exchanger 69, which is arranged in the heat boiler 41. The primary pipe 65 includes a first valve 71. A second valve 73 is arranged between the branch 63 and the heat exchanger 69 in the secondary pipe 67. The secondary pipe 67 is further provided with a non-return valve 75 which is arranged in a vertical part of the secondary pipe 67 between the heat exchanger 69 and the primary pipe 65, viewed in the transport direction of the heat-transport medium. The non-return valve 75 prevents water from the primary pipe 65 reaching the heat exchanger 69 in the first mode of operation of the heat pump, which will be explained more fully hereinafter.

In the case in which the ambient temperature exceeds a given value, such as, for example, −3° C., the heat pump acts as an absorption heat pump in the first mode. A temperature sensor 77 supplies a corresponding signal to a control member 79 which keeps the first valve 71 in the opened state and keeps the second valve 73 in the closed state. The control member 79 adjusts the gas valve 47 to a comparatively small passage opening. In the heat boiler (steam boiler) the auxiliary medium (water) is evaporated to steam which ascends through the riser pipe 39 and arrives in the heat exchanger 37 in the generator 1. The saturated steam in the heat exchanger 37 condenses by heat dissipation to the comparatively cold solution of ethyl amine and glycol in the generator 1. The condensate flows back into the heat boiler 41 under the influence of the force of gravity. Ethyl amine is boiled out of the solution in the generator 1 and leaves the generator 1 through the pipe 9, through which the ethyl amine is introduced into the first cycle. Through the second cycle the poor solution is passed via the pipe 19 and the expansion valve 21 to the absorber 7 where it is enriched. The pump 23 leads the enriched solution back to the generator 1 so that the concentration of the ethyl amine in the generator 1 is maintained. The gaseous ethyl amine in the first cycle is condensed in the condenser 3, after which the liquid ethyl amine is passed via the pipe 11 to the expansion valve 17 where it is expanded at a comparatively low pressure, whereupon the liquid ethyl amine evaporates in the evaporator 5. The ethyl amine now in the gaseous state is passed from the evaporator 5 to the absorber 7 and is absorbed by the solution 51. In the condenser 3 and the absorber 7, the heat produced by condensation and absorption, respectively, is transferred to the heat-transporting medium (water) in the ring pipe 53 via the heat exchangers 59 and 61, respectively. The heat exchanger 69 in the heat boiler 41 is therefore inoperative in the first mode.

It should be noted that by the use of an auxiliary medium as a heat source arranged separately from the absorption heat pump before the generator during the first mode there is no longer any risk of decomposition of the working medium or the solvent. In contrast with the case of direct heating of the generator, in which a high temperature in the liquid film on the bottom of the generator leads soon to the formation of decomposition products, this risk is completely absent with the indirect heating of the generator with a separately arranged heat boiler. Moreover, there is a fairly great freedom in the choice of the auxiliary medium. In fact, any decomposition products of the auxiliary medium can never reach the first cycle or the second cycle.

In the case in which the ambient temperature drops below, for example, −3° C., the heat pump operates in the second mode. The temperature sensor 77 supplies a corresponding signal to the control member 79, which then closes the first valve 71 and opens the second valve 73. The control member 79 further adjusts the gas valve 47 to a comparatively large passage opening so that the gas burner 45 will supply a larger amount of heat than in the first mode. Furthermore, the pump 23 is stopped by the control member 79. This means that a part of the solution still present in the generator 1 is evaporated. This vapour reaches via the condenser 3 the evaporator 5 and finally the absorber 7 because the latter is at a lower level than the evaporator 5. In fact, the absorption heat pump has now been made inoperative because the generator, the condenser, the evaporator and the absorber thermally have no longer any function. The heat transfer to the heat-transport medium (water) now takes place via the heat exchanger 69 in the heat boiler 41. The heat exchanger 69 is preferably arranged entirely in the vapour part of the heat boiler 41. The heat exchangers 59 and 61 in the condenser 3 and the absorber 7, respectively, are now thermally inoperative and solely serve for the transport of the heating water. As the case may be, the ring pipe 53 may be short-circuited by an additional parallel lead (by-pass), the heating water then no longer flowing via the heat exchangers 59 and 61. In this case, however, further valves are required.

During the operation as an absorption heat pump in the first mode, the non-return valve 75 prevents the comparatively cold heating water from the ring pipe 53 and the primary pipe 65, respectively, from being exposed to a comparatively high temperature (approximately 170° C.) in the heat boiler 41. This could lead to pressure surges due to abrupt steam formation. Since the non-return valve 75 is located in a vertical part of the secondary pipe 67, there is constantly a water column above the non-return valve 75 and this water column keeps the temperature gradient across the non-return valve 75 within acceptable limits. The use of a conventional comparatively inexpensive non-return valve is consequently possible. It is preferred to provide the heat boiler 41 with a safety valve 81 (shown diagrammatically) in order to prevent the pressure in the heat boiler 41 from becoming too high, for example in the case in which the temperature sensor 77 becomes defective.

It should be noted that the heat pump according to the invention is particularly suitable for rapid starting after the switched-off condition. In this case, starting can be effected in the second mode in order to ensure that the system is heated rapidly when ambient temperatures exceed a given value (for example, −3° C.). Subsequently, a change-over to the first mode can be effected. This has the particular advantage that the absorption heat pump can operate invariably at an optimum temperature level.

The heat pump described is not limited to the indicated solution (ethyl amine+glycol) and the indicated auxiliary medium (water). Thus, for example, as a solution the combination of ammonia and water may be used, while as an auxiliary medium Diphyl (tradename of a eutectic mixture of diphenyl and diphenyloxide) may be used. The use of water as an auxiliary medium, however, is comparatively inexpensive and yields a particularly satisfactory heat transfer coefficient in the two heat exchangers 37 and 69. It should further be noted that the combination of the heat exchanger 37, the riser pipe 39 and the heat boiler 41 has the function of a heat pipe. It should be appreciated that in principle known heat pipe constructions may be used in the heat pump according to the invention.

The flue gases of the gas burner 45 may also be passed through a further heat exchanger arranged in the liquid auxiliary medium 43 in the heat boiler 41.

Instead of using a gas burner 45 for heating the heat boiler 41, use may of course alternatively be made of other heat sources, such as, for example, an electric heater or an oil burner.

What is claimed is:

1. A method of operating a bimodal heat pump, said heat pump operating in a first mode as an absorption heat pump and in a second mode as a device for indirectly heating a heat-transport medium, which comprises in said first mode heating by heat exchange a generator containing a solution of a working medium in a solvent to separate a part of the dissolved working medium in the gaseous state from the solvent; passing the separated gaseous working medium to a condenser for liquefaction by the giving up of thermal energy to the heat-transport medium; thereafter expanding and evaporating the liquefied working medium in an evaporator by the taking up of thermal energy from the environment; passing the evaporated working medium to an absorber for solution in the solvent while giving up thermal energy to the heat-transport medium; passing another part of the working medium-solvent solution from the generator to the absorber while pumping working medium-solvent solution from the absorber to the generator; and which comprises in said second mode indirectly heating by heat exchange all the heat-transport medium in a heat boiler separate from the generator; and which further comprises, in switching over from the first mode to the second mode, discontinuing the heating of the generator, discontinuing the pumping of the working medium-solvent solution between the absorber and the generator, and diverting all the heat-transport medium to and through the heat boiler for indirect heating by heat exchange therein; and which also comprises, in switching back from the second mode to the first mode, restarting the heating of the generator and the pumping of the working medium-solvent solution, and discontinuing passing the heat-transport medium through the heat boiler.

2. A bimodal heat pump for use in a first mode as an absorption heat pump and in a second mode as a device for indirectly heating a heat-transport medium, which comprises, for operation in said first mode, a generator containing a solution of a working medium in a solvent and including a first heat exchanger to effect separation of a part of the dissolved working medium in the gaseous state from the solvent; a first passage for conducting the separated gaseous working medium to a condenser for liquefaction by the giving up of thermal energy to the heat-transport medium; a second passage for conducting the liquefied working medium to an evaporator for expansion and evaporation by the taking up of thermal energy from the environment; a third passage for conducting the evaporated working medium to an absorber for solution in the solvent while giving up thermal energy to the heat-transport medium; a fourth passage for conducting another part of the working medium-solvent solution from the generator to the absorber; a fifth passage including means for pumping working medium-solvent solution from the absorber to the generator; and which comprises, for operation in said second mode, a heat boiler separate from the generator and including a second heat exchanger for indirectly heating all the heat-transport medium; and which further comprises, for switching over from the first mode to the second mode, means to discontinue the heating of the generator, means to discontinue the pumping of the working medium-solvent solution between the absorber and the generator, and means for diverting all the heat-transport medium to and through the heat boiler for indirect heating therein; and which also comprises, for switching back from the second mode to the first mode, means for restarting the heating of the generator, means for restarting the pumping of the working medium-solvent solution, and means for discontinuing the passage of the heat-transport medium through the heat boiler.

3. A bimodal heat pump according to claim 2, which includes an endless pipe system for conducting the heat-transport medium through the condenser and the absorber; a branch in said system after the absorber for alternatively conducting the heat-transport medium through the second heat exchanger arranged in the heat boiler; a first valve in said system after the branch; and a second valve in said branch before said second heat exchanger, said valves serving to respectively control the flow of heat-transport medium through the system per se and through the branch.

4. A bimodal heat pump according to claim 3, which includes a non-return valve arranged in the branch after the second heat exchanger.

5. A bimodal heat pump according to claim 2, in which the heat boiler is a steam boiler heated by a controllable heat source.

* * * * *